US009247336B2

(12) United States Patent
Lee et al.

(10) Patent No.: US 9,247,336 B2
(45) Date of Patent: Jan. 26, 2016

(54) APPARATUS AND METHOD FOR CONFIRMING CONTROL INFORMATION OF EARPHONE IN PORTABLE TERMINAL

(75) Inventors: Woo-Cheol Lee, Suwon-si (KR); Hyo-Jin Kim, Suwon-si (KR)

(73) Assignee: Samsung Electronics Co., Ltd (KR)

( * ) Notice: Subject to any disclaimer, the term of this patent is extended or adjusted under 35 U.S.C. 154(b) by 289 days.

(21) Appl. No.: 13/612,171

(22) Filed: Sep. 12, 2012

(65) Prior Publication Data

US 2013/0070937 A1 Mar. 21, 2013

(30) Foreign Application Priority Data

Sep. 20, 2011 (KR) ..... 10-2011-0094653

(51) Int. Cl.

| | |
|---|---|
| ***H04R 1/10*** | (2006.01) |
| ***H04R 29/00*** | (2006.01) |
| ***H04R 3/00*** | (2006.01) |
| ***H04R 5/04*** | (2006.01) |

(52) U.S. Cl.

CPC ..... *H04R 1/1041* (2013.01); *H04R 29/00* (2013.01); *H04R 3/007* (2013.01); *H04R 5/04* (2013.01); *H04R 2420/05* (2013.01); *H04R 2420/09* (2013.01)

(58) Field of Classification Search

None

See application file for complete search history.

(56) References Cited

U.S. PATENT DOCUMENTS

| | | | | |
|---|---|---|---|---|
| 7,623,667 | B2 * | 11/2009 | Sander et al. | 381/74 |
| 2011/0085673 | A1 * | 4/2011 | Lee | 381/74 |

FOREIGN PATENT DOCUMENTS

| | | |
|---|---|---|
| KR | 1020060074206 | 8/2006 |

* cited by examiner

*Primary Examiner* — Daniell L Negron

(74) *Attorney, Agent, or Firm* — The Farrell Law Firm, P.C.

(57) ABSTRACT

An apparatus and method for confirming control information that is input through an earphone in a portable terminal are provided. The apparatus includes an interface to which an earphone connects, and a controller for creating bit information dependent on a key input provided from the earphone connected through the interface, and confirming control information corresponding to the bit information.

12 Claims, 9 Drawing Sheets

APPARATUS AND METHOD FOR CONFIRMING CONTROL INFORMATION OF EARPHONE IN PORTABLE TERMINAL

PRIORITY

This application claims priority under 35 U.S.C. §119(a) to a Korean Patent Application filed in the Korean Intellectual Property Office on Sep. 20, 2011 and assigned Serial No. 10-2011-0094653, the contents of which are incorporated herein by reference.

BACKGROUND OF THE INVENTION

1. Field of the Invention

The present invention relates generally to an apparatus and method for confirming control information of an earphone in a portable terminal.

2. Description of the Related Art

The proliferation of portable terminals is largely due to the decrease in their size and weight, along with the increase of their functions. Service providers and terminal manufacturers are competitively developing services and products for the portable terminals, such as multimedia services including games and Motion Pictures Experts Group (MPEG)-1 Layer Audio 3 (MP3) playing.

To prevent the indiscreet use of the multimedia services in public places, many portable terminals are provided with earphones for the multimedia services.

The portable terminals may provide voice, music and audio signals through the earphones. However, the conventional art is inconvenient from the standpoint that the user has to control the multimedia or call service being provided through the earphone, through an input unit of the portable terminal. For example, when playing an MP3 file, the user has to inconveniently manipulate the input unit of the portable terminal to control the MP3 file. Furthermore, volume adjustment of an audio signal must inconveniently occur at the portable terminal.

Accordingly, there is a need in the art for a method of controlling a function of a portable terminal using an earphone.

SUMMARY OF THE INVENTION

An aspect of the present invention is to substantially solve at least the above problems and/or disadvantages and to provide at least the advantages below. Accordingly, one aspect of the present invention is to provide an apparatus and method for controlling a function of a portable terminal using an earphone.

Another aspect of the present invention is to provide an apparatus and method for recognizing control information that is input through an earphone in a portable terminal.

A further aspect of the present invention is to provide an apparatus and method for recognizing control information that is input through an earphone using a level trigger scheme in a portable terminal.

Yet another aspect of the present invention is to provide an apparatus and method for recognizing control information that is input through an earphone using a voltage comparator in a portable terminal.

Still another aspect of the present invention is to provide an apparatus and method for recognizing control information that is input through an earphone considering a key input time input through an earphone in a portable terminal.

Still another aspect of the present invention is to provide an apparatus and method for recognizing control information that is input through a 4-pole earphone of a 3.5 pi interface in a portable terminal.

The above aspects are achieved by providing an apparatus and method for confirming control information of an earphone in a portable terminal.

According to an aspect of the present invention, a portable terminal apparatus includes an interface to which an earphone to connected, and a controller which creates bit information dependent on a key input provided from the earphone connected through the interface, and confirms control information corresponding to the bit information.

The controller according to the present invention confirms the type of the earphone connected through the interface considering a voltage level measured at any one pole being provided with the key input from the earphone among 4 poles included in the interface.

The plurality of comparators according to the present invention includes a 1st comparator for comparing a 1st reference voltage and a voltage of the key input provided from the earphone, and outputting a 1st bit value, and at least one 2nd comparator for outputting at least one 2nd bit value considering a 2nd reference voltage, the voltage of the key input provided from the earphone, and a bit output voltage of the 1st comparator.

According to another aspect of the present invention, a method for confirming control information that is input through an earphone in a portable terminal includes determining whether an earphone is inserted, creating, when the earphone is inserted, bit information dependent on a key input provided from the earphone, and confirming control information corresponding to the bit information.

Creating the bit information according to the present invention includes outputting a 1st bit value using a 1st comparator for comparing a 1st reference voltage and a voltage of the key input provided from the earphone, and outputting at least one 2nd bit value using at least one 2nd comparator for comparing a 2nd reference voltage, the voltage of the key input provided from the earphone, and a bit output voltage of the 1st comparator.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF EMBODIMENTS OF THE INVENTION

Embodiments of the present invention will be described herein below with reference to the accompanying drawings. Terms described below, which are defined considering functions in the present invention, can be different depending on user and operator's intention or practice. Therefore, the terms should be defined on the basis of the disclosure throughout this specification. In the following description, well-known functions or constructions are not described in detail for the sake of clarity and conciseness.

The present invention provides a technology for confirming control information that is input through an earphone in a level trigger scheme in a portable terminal.

In the following description, a portable terminal includes devices such as a mobile communication terminal into which an earphone is inserted, a Portable Digital Assistant (PDA), a laptop, a smartphone, a netbook, a Mobile Internet Device (MID), a Ultra Mobile Personal Computer (UMPC), a tablet Personal Computer (PC), an MP3 player, a Portable Multimedia Player (PMP), and a navigation device.

The following description is based on a 4-pole earphone. However, the portable terminal can identically confirm control information that is input through the earphone even when an earphone of another scheme is used.

Figure 1:
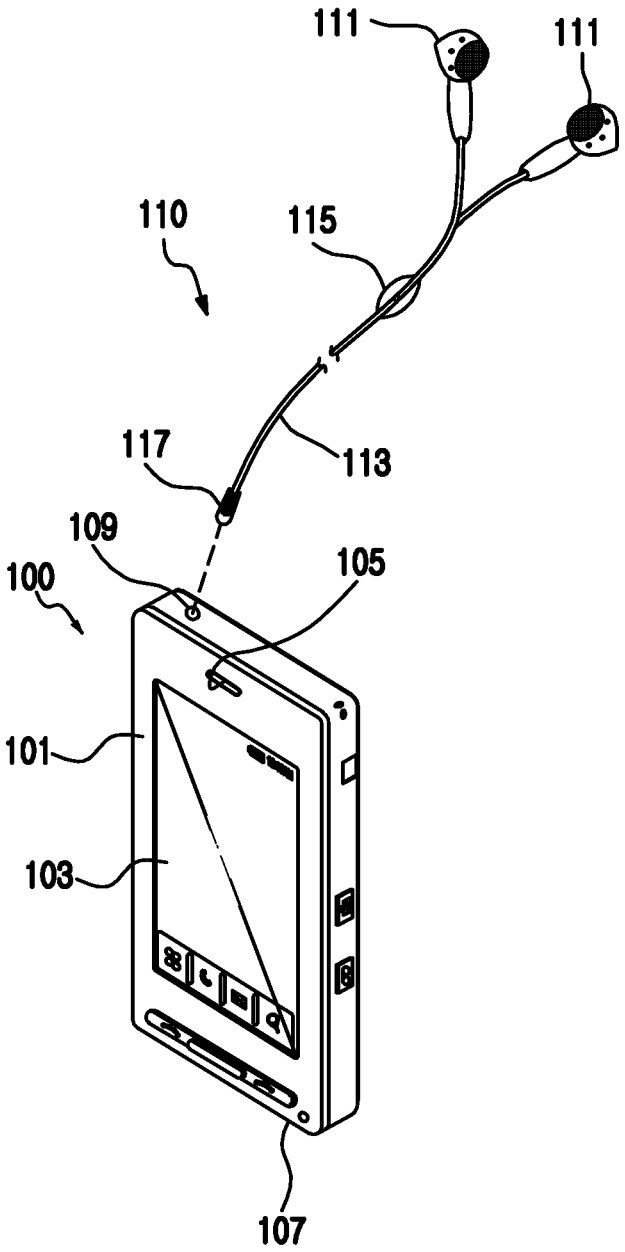
FIG. 1 illustrates a state in which an earphone according to an embodiment of the present invention is applied to a portable terminal.

FIG. 1 illustrates a state in which an earphone according to an embodiment of the present invention is applied to a portable terminal.

As illustrated in FIG. 1, the portable terminal 100 includes a body 101, a display unit 103 installed on a front surface of the body 101, a speaker 105 installed in an upper part of the display unit 103, and a microphone device 107 installed at a lower side of the display unit 103. An ear jack 109 is installed at an upper side of the body 101, and houses an earplug 117 of an earphone device 110.

The earphone device 110 includes a cable 113 of a constant length, the earplug 117 connected to one end of the cable 113, and a pair of earphones 111 branching and connected to the other end of the cable 113. A microphone device 115 is interposed on the cable 113 and includes a button for controlling a function of the portable terminal 100.

Figure 2:
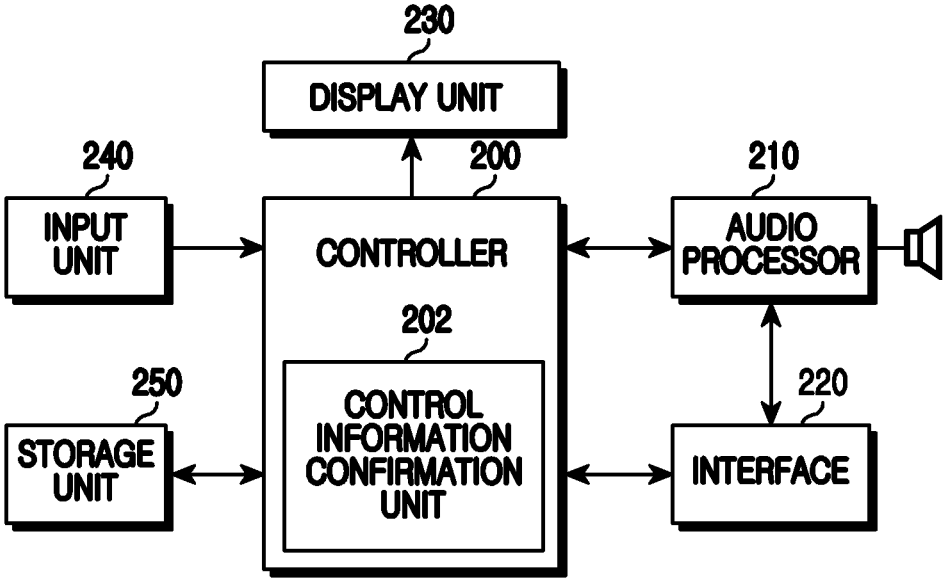
FIG. 2 illustrates a construction of a portable terminal according to the present invention.

FIG. 2 illustrates a construction of a portable terminal according to the present invention.

As illustrated in FIG. 2, the portable terminal includes a controller 200, an audio processor 210, an interface 220, a display unit 230, an input unit 240, and a storage unit 250.

The controller 200 controls the overall operation of the portable terminal. In detail, when insertion of an earphone through the interface 220 is confirmed, the controller 200 controls to input/output an audio signal through the earphone inserted into the interface 220.

The controller 200 determines the insertion or non-insertion of the earphone capable of inputting control information, considering a voltage level of the earphone connected to the portable terminal through the interface 220. For example, when the interface 220 is composed of 4 poles, the controller 200 determines whether a 3-pole earphone or a 4-pole earphone has been inserted considering a voltage level of a 3rd pole of the interface 220 of the portable terminal connected with a microphone device of the 4-pole earphone.

Specifically, when an earphone including a 3-pole interface is inserted through the interface 220, a 3rd pole of the interface 220 is connected with the ground portion of the 3-pole earphone. In contrast, when an earphone including a 4-pole interface is inserted through the interface 220, the 3rd pole of the interface 220 is connected with the microphone device of the 4-pole earphone. That is, when the 4-pole earphone is inserted into the interface 220, the voltage level confirmed at the 3rd pole of the interface 220 is higher than when the 3-pole earphone is inserted. Accordingly, the controller 200 can confirm the type of the inserted earphone considering the voltage level confirmed at the 3rd pole of the interface 220.

When the control information confirmation unit 202 confirms control information that is input through the earphone, the controller 200 controls an operation of the portable terminal according to the confirmed control information. For example, when the control information confirmation unit 202 confirms control information for volume adjustment during music playing, the controller 200 adjusts a volume of the playing music.

Figure 3:
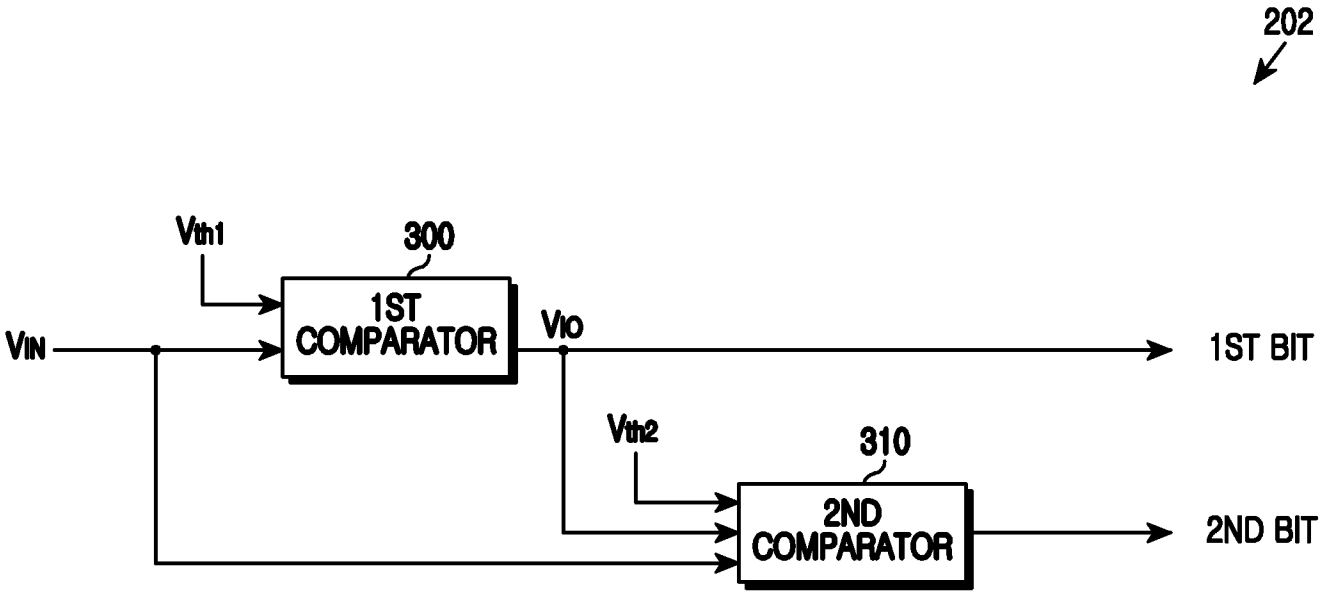
FIG. 3 illustrates a detailed construction of a control information confirmation unit according to an embodiment of the present invention.

The control information confirmation unit 202 creates bit information about a key input that is input through the earphone in a level trigger scheme, and confirms control information corresponding to the key input that is input through the earphone. For example, as illustrated in FIG. 3 below, the control information confirmation unit 202 confirms a bit value of control information corresponding to a key input of the earphone provided through the interface 220 using two comparators 300 and 310. In this case, the controller 200 controls an operation of the portable terminal according to the control information corresponding to the bit value provided from the control information confirmation unit 202.

Figure 5:
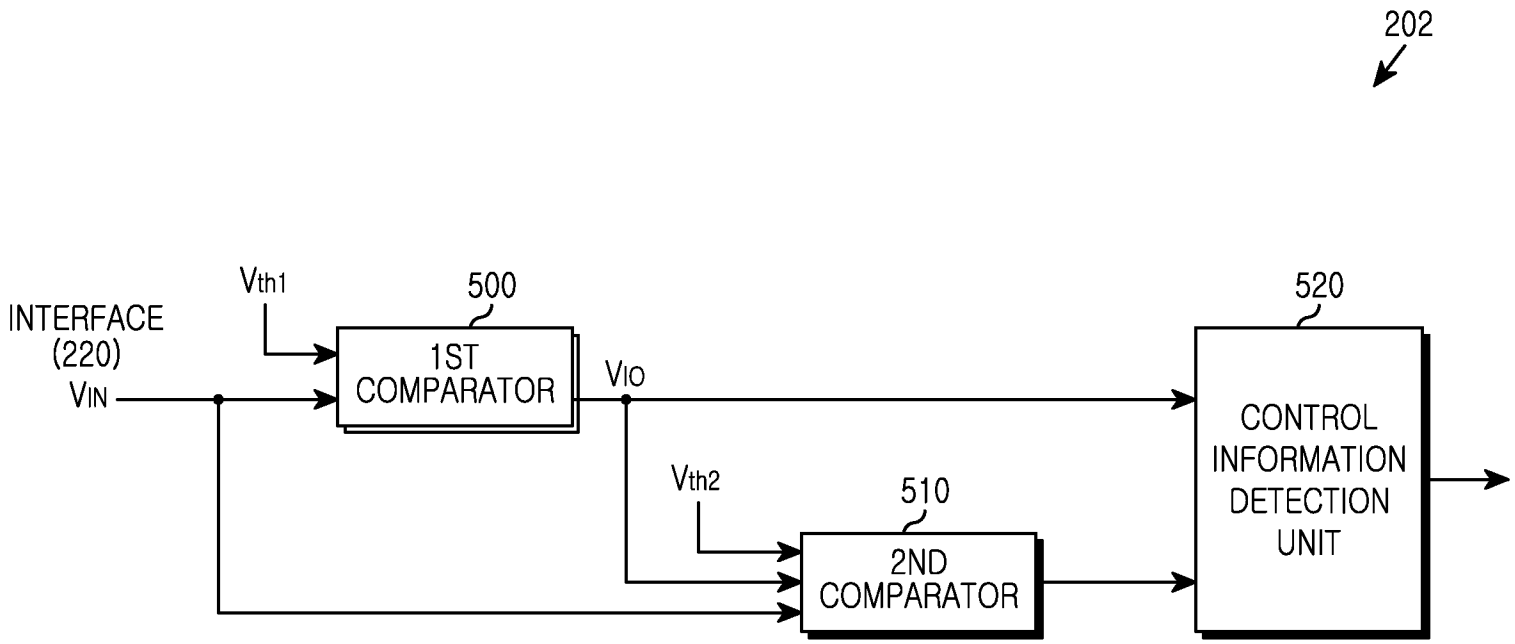
FIG. 5 illustrates a detailed construction of a control information confirmation unit according to another embodiment of the present invention.

As another example, as illustrated in FIG. 5 below, the control information confirmation unit 202 confirms control information corresponding to a key input of the earphone provided through the interface 220 using two comparators 500 and 510 and a control information detection unit 520. In this case, the controller 200 controls an operation of the portable terminal according to the control information provided from the control information confirmation unit 202.

According to the control of the controller 200, the audio processor 210 performs a function of playing an audio signal, which is provided from the controller 200, through a SPeaKer (SPK) or transmitting an audio signal, which is input through a MICrophone (MIC), to the controller 200. When the earphone is inserted into the interface 220, the audio processor 210 performs a function of playing an audio signal, which is provided from the controller 200, through the earphone according to the control of the controller 200. When the MIC is interposed in the earphone, the audio processor 210 performs a function of transmitting an audio signal, which is input through the MIC interposed in the earphone, to the controller 200.

The interface 220 provides a connection means for the earphone to connect with the portable terminal and transmit/receive an audio signal with the portable terminal. For example, the interface 220 provides an interface for communication between the portable terminal and the earphone, and a path for transmitting an audio signal, which is forwarded from the microphone of the earphone, to the audio processor 210 and transmitting an audio signal, which is forwarded from the audio processor 210, to an output device of the earphone.

The display unit 230 displays such information as a status of the portable terminal, a moving picture, and a still picture according to the control of the controller 200.

The input unit 240 provides input data generated by user's selection to the controller 200.

The storage unit 250 can include a program storage unit for storing a program for controlling an operation of the portable terminal, and a data storage unit for storing data generated during program execution. For instance, the program storage unit of the storage unit 250 may store a program for the control information confirmation unit 202 to create bit information about a key input that is input through the earphone in a level trigger scheme and confirm control information corresponding to the key input that is input through the earphone. In this case, the control information confirmation unit 202 executes the program stored in the program storage unit, creates the bit information about the key input that is input through the earphone, and confirms the control information corresponding to the key input that is input through the earphone.

In the following description, the control information confirmation unit 202 includes two comparators each having a different characteristic so as to confirm control information of two bits corresponding to one key input provided from an earphone.

FIG. 3 illustrates a detailed construction of a control information confirmation unit according to an embodiment of the present invention.

As illustrated in FIG. 3, the control information confirmation unit 202 includes a first ($1^{st}$) comparator 300 and a second ($2^{nd}$) comparator 310.

The 1st comparator 300 compares a reference voltage ($V_{th1}$) of the 1st comparator 300 with a key input voltage ($V_{IN}$) provided from an earphone, and outputs a 1st bit value. For instance, if the reference voltage ($V_{th1}$) is less than the key input voltage ($V_{IN}$), the 1st comparator 300 outputs '1' (high) as the 1st bit value. In contrast, if the reference voltage ($V_{th1}$) is greater than or equal to the key input voltage ($V_{IN}$), the 1st comparator 300 outputs '0' (low) as the 1st bit value.

Figure 4:
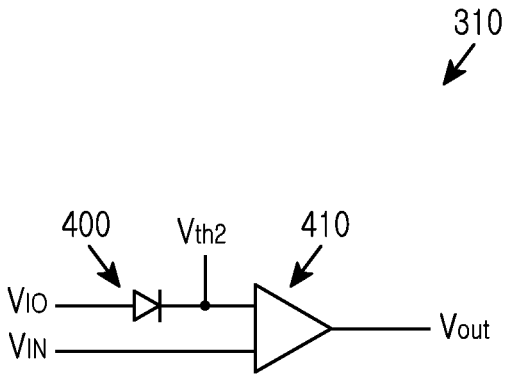
FIG. 4 illustrates a detailed construction of a 2nd comparator according to an embodiment of the present invention.

The 2nd comparator 310 compares a reference voltage ($V_{th2}$) of the 2nd comparator 310 with a key input voltage ($V_{IN}$) provided from the earphone and an output voltage ($V_{IO}$) of the 1st comparator 300, and outputs a 2nd bit value. For example, the 2nd comparator 310 is constructed as illustrated in FIG. 4. In this case, the 2nd comparator 310 determines a higher one of the reference voltage ($V_{th2}$) of the 2nd comparator 310 and the output voltage ($V_{IO}$) of the 1st comparator 300 as a reference voltage to be used for determining the 2nd bit value, using a diode 400. After that, the 2nd comparator 310 compares the reference voltage to be used for determining the 2nd bit value and the key input voltage ($V_{IN}$) through a comparator 410, and outputs the 2nd bit value. If the reference voltage to be used for determining the 2nd bit value is less than the key input voltage ($V_{IN}$), the 2nd comparator 310 outputs '1' (high) as the 2nd bit value. In contrast, if the reference voltage to be used for determining the 2nd bit value is greater than or equal to the key input voltage ($V_{IN}$), the 2nd comparator 310 outputs '0' (low) as the 2nd bit value.

At this time, the controller 200 of FIG. 2 confirms control information corresponding to bit information, which is composed of the 1st bit value of the 1st comparator 300 and the 2nd bit value of the 2nd comparator 310. For example, the controller 200 confirms control information corresponding to bit information using Table 1 below.

TABLE 1

| Control information | 1st comparator | 2nd comparator |
|---|---|---|
| Call/end | 0 (Low) | 0 (Low) |
| Sleep state | 0 (Low) | 1 (High) |
| Volume down | 1 (High) | 0 (Low) |
| Volume up | 1 (High) | 1 (High) |

According to Table 1 above, if the controller 200 is provided with bit information '10' from the control information confirmation unit 202, the controller 200 recognizes that control information for volume down is input through an earphone. If the controller 200 is provided with bit information '11' from the control information confirmation unit 202, the controller 200 recognizes that control information for volume up is input through the earphone. If the controller 200 is provided with bit information '00' from the control information confirmation unit 202, the controller 200 recognizes that control information for call/end is input through the earphone.

In the aforementioned embodiment, the control information confirmation unit 202 is constructed to provide bit information corresponding to a key input of an earphone to the controller 200.

In another embodiment, the control information confirmation unit 202 may be constructed to provide control information corresponding to a key input of an earphone to the controller 200, as in FIG. 5 as follows.

FIG. 5 illustrates a detailed construction of a control information confirmation unit according to another embodiment of the present invention.

As illustrated in FIG. 5, the control information confirmation unit 202 includes a 1st comparator 500, a 2nd comparator 510, and a control information detection unit 520.

The 1st comparator 500 compares a reference voltage ($V_{th1}$) of the 1st comparator 500 with a key input voltage ($V_{IN}$) provided from an earphone, and outputs a 1st bit value. For instance, if the reference voltage ($V_{th1}$) is less than the key input voltage ($V_{IN}$), the 1st comparator 500 outputs '1' (high) as the 1st bit value. In contrast, if the reference voltage ($V_{th1}$) is greater than or equal to the key input voltage ($V_{IN}$), the 1st comparator 500 outputs '0' (low) as the 1st bit value.

The 2nd comparator 510 compares a reference voltage ($V_{th2}$) of the 2nd comparator 510 with a key input voltage ($V_{IN}$) provided from the earphone and an output voltage ($V_{IO}$) of the 1st comparator 500, and outputs a 2nd bit value. For example, the 2nd comparator 510 as constructed in FIG. 4 determines a higher one of the reference voltage ($V_{th2}$) of the 2nd comparator 510 and the output voltage ($V_{IO}$) of the 1st comparator 500 as a reference voltage to be used for determining the 2nd bit value, using a diode 400. After that, the 2nd comparator 510 compares the reference voltage to be used for determining the 2nd bit value and the key input voltage ($V_{IN}$) through a comparator 410, and outputs the 2nd bit value. If the reference voltage to be used for determining the 2nd bit value is less than the key input voltage ($V_{IN}$), the 2nd comparator 510 outputs '1' (high) as the 2nd bit value. In contrast, if the reference voltage to be used for determining the 2nd bit value is greater than or equal to the key input voltage ($V_{IN}$), the 2nd comparator 510 outputs '0' (low) as the 2nd bit value.

The control information detection unit 520 detects control information corresponding to bit information, which is composed of the 1st bit value of the 1st comparator 500 and the 2nd bit value of the 2nd comparator 510. For example, the control information detection unit 520 confirms control information corresponding to bit information using Table 1 above.

At this time, the control information detection unit 520 may detect control information considering the bit information configured in the 1st comparator 500 and 2nd comparator 510 and a key input time of the earphone. Specifically, the control information detection unit 520 detects control information corresponding to the bit information configured in the 1st comparator 500 and 2nd comparator 510, and may change the detected control information considering the key input time of the earphone.

For instance, when the control information detection unit 520 detects control information about volume up according to bit information, the control information detection unit 520 recognizes that the control information input through the earphone is fast forward, if the key input time through the earphone exceeds a reference time. That is, the control information detection unit 520 changes the volume up control information, which is detected through the bit information, into fast forward control information according to the key input time.

In the aforementioned embodiment, the control information confirmation unit 202 includes the two comparators 300 and 310 (or 400 and 410) in order to confirm four pieces of control information of binary codes.

In another embodiment, the control information confirmation unit 202 may include three or more comparators, i.e., one 1st comparator and a plurality of 2nd comparators.

For instance, to acquire bit information about a key input provided through an earphone, the control information confirmation unit 202 can set a reference voltage ($V_{th1}$) of the 1st comparator 300 or 500 to 1.0 V, set an input/output voltage ($V_{IO}$) of the 1st comparator 300 or 500 to 1.8 V, and set a reference voltage ($V_{th2}$) of the 2nd comparator 310 or 510 to 0.5 V in the construction of FIG. 3 or 5. The control information confirmation unit 202 can confirm control information as shown in Table 2 below.

TABLE 2

| Control information | 1st comparator | 2nd comparator |
|---|---|---|
| Call/end (0.12 V) | 0 (Low) (0 V) | 0 (Low) (0 V) |
| Sleep state (0.8 V) | 0 (Low) (0 V) | 1 (High) (1.8 V) |
| Volume down (1.2 V) | 1 (High) (1.8 V) | 0 (Low) (0 V) |
| Volume up (2.6 V) | 1 (High) (1.8 V) | 1 (High) (1.8 V) |

According to Table 2, when the control information confirmation unit 202 is provided with a key input of 0.12 V from an earphone according to the construction of FIG. 3 or 5, the control information confirmation unit 202 creates bit information of '00' and recognizes that control information for call/end is input. When the control information confirmation unit 202 is provided with a key input of 1.2 V from the earphone, the control information confirmation unit 202 creates bit information of '10' and recognizes that control information for volume down is input. When the control information confirmation unit 202 is provided with a key input of 2.6 V from the earphone, the control information confirmation unit 202 creates bit information of '11' and recognizes that control information for volume up is input.

Figure 6:
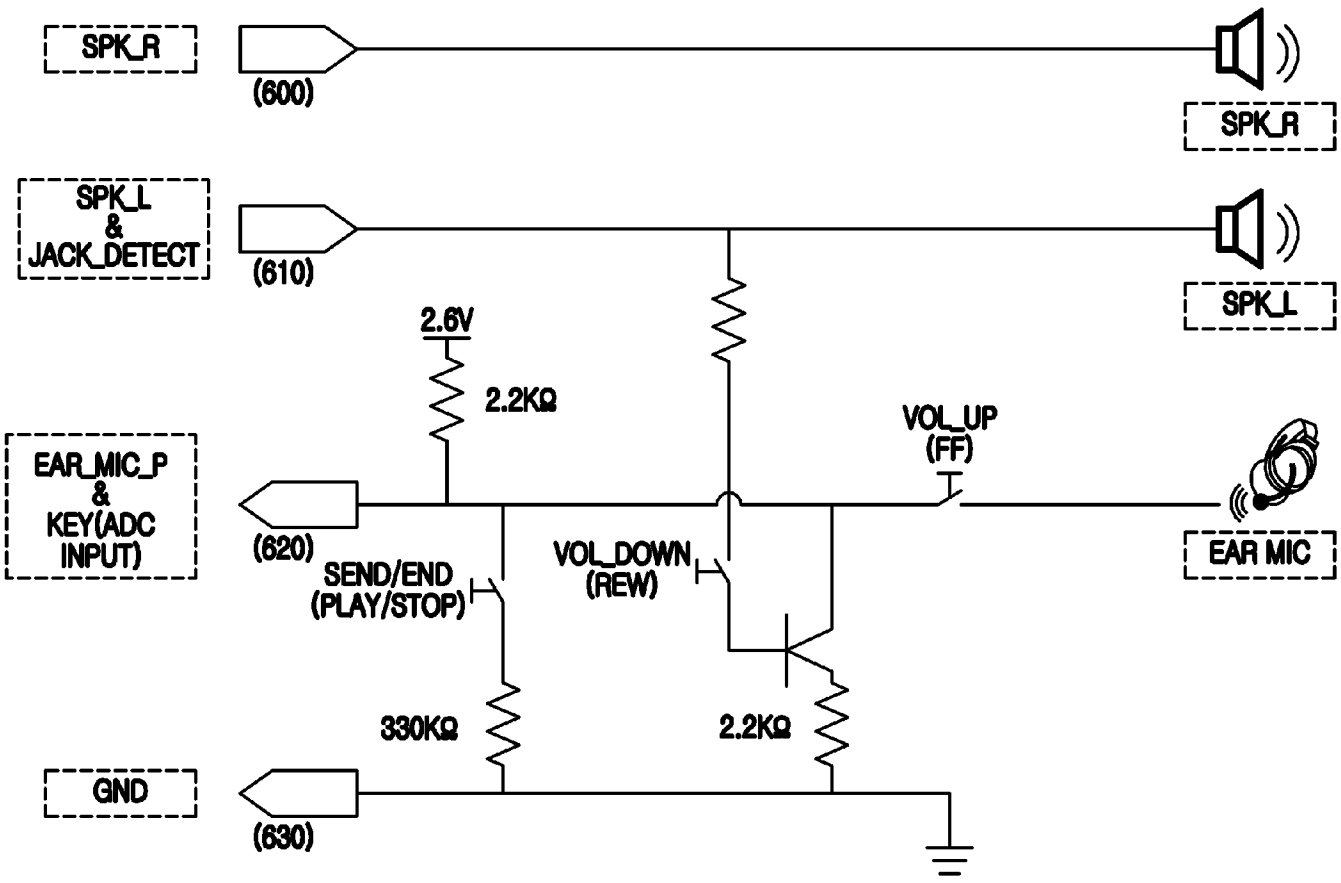
FIG. 6 illustrates a construction of an earphone according to an embodiment of the present invention.

Accordingly, as illustrated in FIG. 6, the earphone can be constructed to selectively provide a voltage of 0.12 V for call/end, a voltage of 1.2 V for volume down, and a voltage of 2.6 V for volume up, to the portable terminal.

FIG. 6 illustrates a construction of an earphone according to an embodiment of the present invention.

In FIG. 6, when the earphone is composed of 4 poles, the earphone includes a 1st pole 600 for connecting a right speaker (SPK_R) of the earphone and a portable terminal, a 2nd pole 610 for connecting a left speaker (SPK_L) of the earphone and the portable terminal, a 3rd pole 620 for connecting a microphone (EAR MIC) of the earphone and the portable terminal, and a 4th pole 630 for the GrouND (GND) of the earphone.

When the control information confirmation unit 202 of the portable terminal confirms control information input through the earphone using configuration information of Table 2 above, the earphone provides 0.12 V to the control information confirmation unit 202 through the 3rd pole 620 if a user manipulates a microphone device for call or call end. Also, the earphone provides 1.2 V to the control information confirmation unit 202 through the 3rd pole 620 if the user manipulates the microphone device for volume down (VOL_DOWN), and provides 2.6 V to the control information confirmation unit 202 through the 3rd pole 620 if the user manipulates the microphone device for volume up (VOL_UP).

In the following embodiment, a description is made for when the portable terminal confirming the control information input through the earphone using the configuration information of Table 2 above is connected to a vehicle handsfree.

Figure 7:
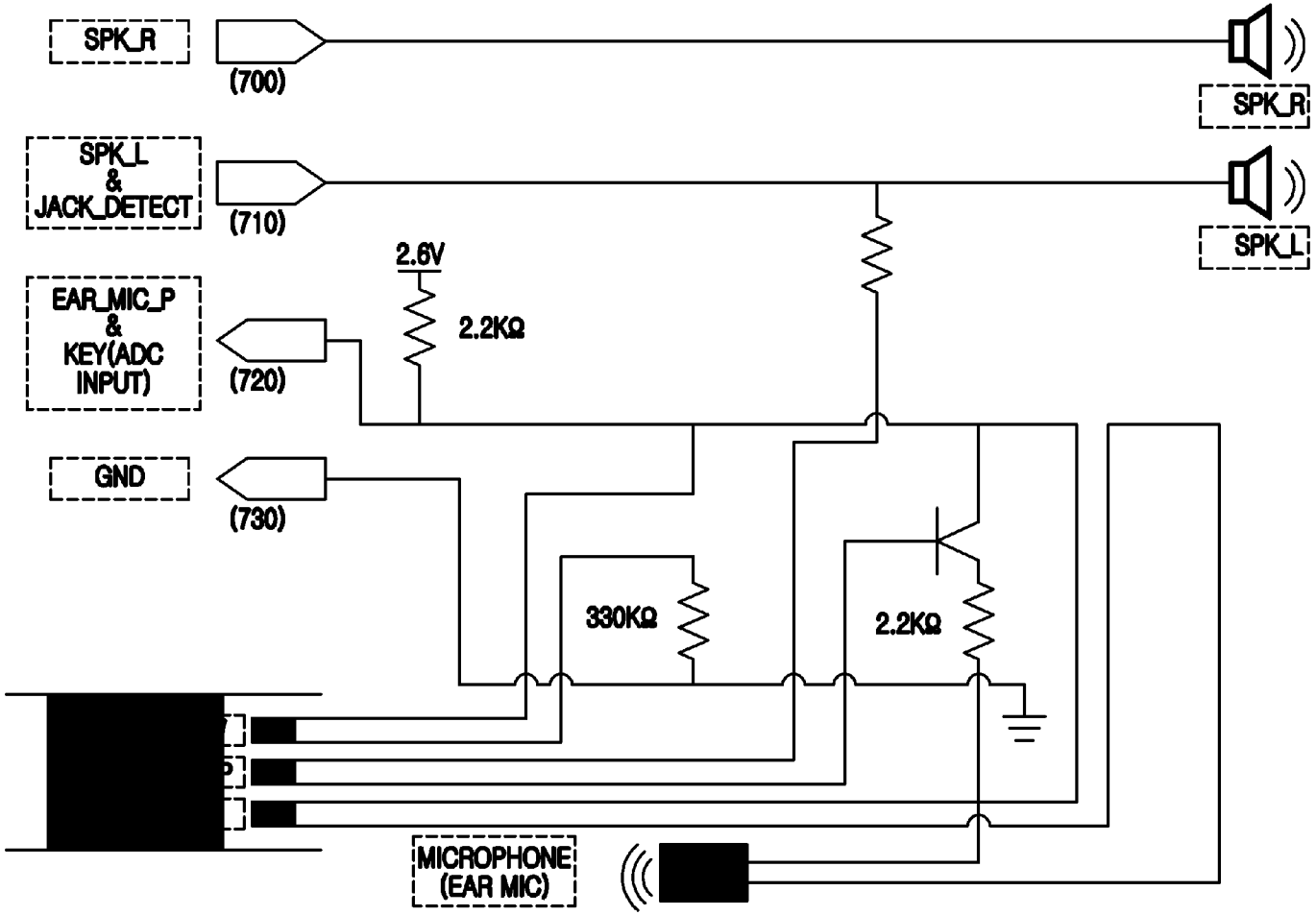
FIG. 7 illustrates a construction of a vehicle handsfree according to an embodiment of the present invention.

FIG. 7 illustrates a construction of a vehicle handsfree according to an embodiment of the present invention.

In FIG. 7, when the vehicle handsfree is connected with a portable terminal using a 4-pole interface of the vehicle handsfree, the vehicle handsfree connects its right speaker (SPK_R) and left speaker (SPK_L) and the portable terminal using a 1st pole 700 and a 2nd pole 710, respectively, connects a vehicle remote control device and the portable terminal using a 3rd pole 720, and connects with the ground using a 4th pole 730.

When the control information confirmation unit 202 of the portable terminal confirms control information input through an earphone using the configuration information of Table 2 above, the vehicle handsfree provides 0.12 V to the control information confirmation unit 202 through the 3rd pole 720, if a user manipulates the remote control device for call or call end. The vehicle handsfree provides 1.2 V to the control information confirmation unit 202 through the 3rd pole 720, if the user manipulates the remote control device for volume down, and provides 2.6 V to the control information confirmation unit 202 through the 3rd pole 720, if the user manipulates the remote control device for volume up.

Figure 8:
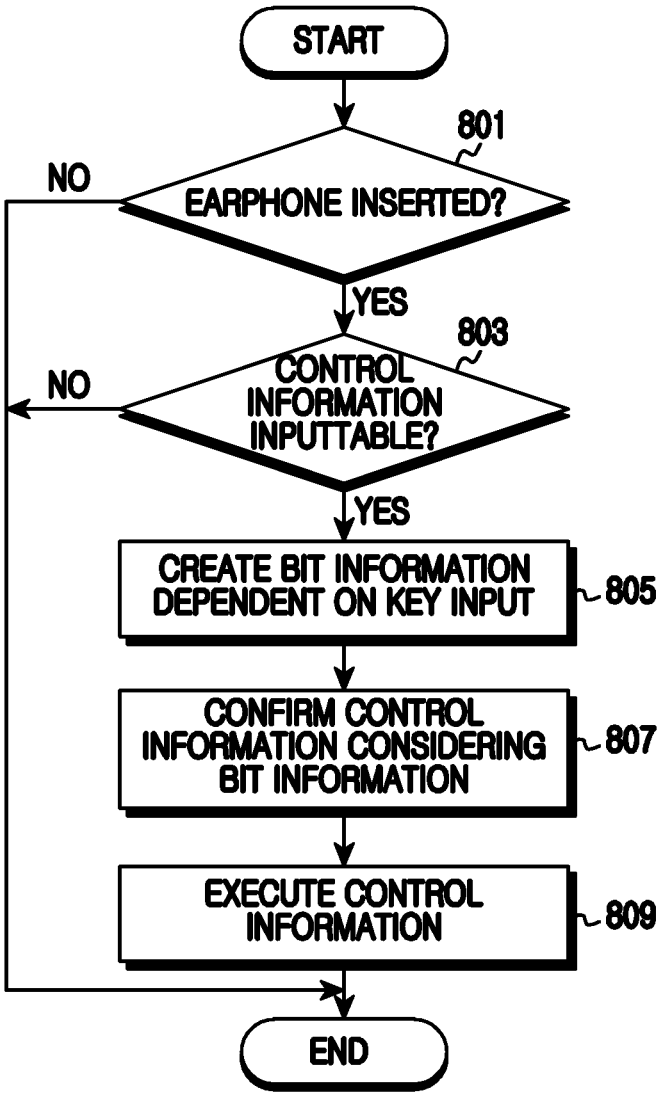
FIG. 8 illustrates a procedure for confirming control information that is input through an earphone in a portable terminal according to an embodiment of the present invention.

FIG. 8 illustrates a procedure for confirming control information that is input through an earphone in a portable terminal according to an embodiment of the present invention. However, even when the portable terminal is connected to a vehicle handsfree, the portable terminal can identically confirm control information input through the vehicle handsfree.

Referring to FIG. 8, in step 801, the portable terminal determines whether an earphone is inserted into the portable terminal. For example, as in FIG. 6, when the earphone is connected to the portable terminal through its 4-pole interface, the portable terminal determines whether earphone connection information is detected through a 2nd pole 610 of the earphone.

If the earphone is not connected in step 801, the portable terminal terminates the algorithm.

If the earphone is connected in step 801, the portable terminal proceeds to step 803 and determines whether it can be provided with control information from the earphone. For example, when the portable terminal includes a 4-pole interface, the portable terminal determines whether the connected earphone is a 3-pole or a 4-pole earphone considering a voltage level of a 3rd pole of the 4-pole interface of the portable terminal connected with a microphone device of the 4-pole earphone.

Specifically, when an earphone including a 3-pole interface is inserted into the portable terminal, the 3rd pole of the 4-pole interface of the portable terminal is connected with the ground portion of the 3-pole earphone. In contrast, when an earphone including a 4-pole interface is inserted into the portable terminal, the 3rd pole of the 4-pole interface of the portable terminal is connected with the microphone device of the 4-pole earphone. That is, when the 4-pole earphone is inserted into the portable terminal, a voltage level confirmed at the 3rd pole of the 4-pole interface of the portable terminal is higher than when the 3-pole earphone is inserted. Accordingly, the portable terminal can confirm whether the earphone connected to the 4-pole interface of the portable terminal is the 3-pole earphone or the 4-pole earphone considering the voltage level of the 3rd pole of the 4-pole interface of the portable terminal.

If the portable terminal cannot be provided with control information through the earphone in step 803, the portable terminal terminates the algorithm. That is, when the 3-pole earphone is connected to the portable terminal, the portable terminal recognizes that it cannot be provided with the control information through the 3-pole earphone, and terminates the algorithm.

In contrast, if the portable terminal can be provided with the control information through the earphone in step 803, the portable terminal proceeds to step 805 and creates bit information dependent on a key input provided through the earphone. For example, in the construction of FIG. 3, a reference voltage ($V_{th1}$) of a 1st comparator 300 is set to 1.0 V, an input/output voltage ($V_{IO}$) of the 1st comparator 300 is set to 1.8 V, a reference voltage ($V_{th2}$) of a 2nd comparator 310 is set to 0.5 V, and the earphone is constructed as in FIG. 6.

When a key input of 0.8 V is generated from the earphone, the 1st comparator 300 of the portable terminal outputs '0' (Low) as a 1st bit value because the key input voltage 0.8 V is lower than the reference voltage 1.0 V of the 1st comparator 300. Since the output voltage of the 1st comparator 300 is equal to 0 V, the 2nd comparator 310 determines, by 0.5 V, a reference voltage to be used for determining a 2nd bit value, outputs '1' (High) as the 2nd bit value, and creates bit information of '01'. When a key input of 1.2 V is generated from the earphone, the 1st comparator 300 of the portable terminal outputs '1' (High) as the 1st bit value because the key input voltage 1.2 V is higher than the reference voltage 1.0 V of the 1st comparator 300. Since the output voltage of the 1st comparator 300 is equal to 1.8 V, the 2nd comparator 310 determines, by 1.8 V, the reference voltage to be used for determining the 2nd bit value, outputs '0' (Low) as the 2nd bit value, and creates bit information of '10'.

When a key input of 2.6 V is generated from the earphone, the 1st comparator 300 of the portable terminal outputs '1' (High) as the 1st bit value because the key input voltage 2.6 V is higher than the reference voltage 1.0 V of the 1st comparator 300. Since the output voltage of the 1st comparator 300 is equal to 1.8 V, the 2nd comparator 310 determines, by 1.8 V, the reference voltage to be used for determining the 2nd bit value, outputs '1' (High) as the 2nd bit value, and creates bit information of '11'. When a key input of 0.12 V is generated from the earphone, the 1st comparator 300 of the portable terminal outputs '0' (Low) as the 1st bit value because the key input voltage 0.12 V is higher than the reference voltage 1.0 V of the 1st comparator 300. Since the output voltage of the 1st comparator 300 is equal to 0 V, the 2nd comparator 310 determines, by 0.5 V, the reference voltage to be used for determining the 2nd bit value, outputs '0' (Low) as the 2nd bit value, and creates bit information of '00'.

The portable terminal then proceeds to step 807 and confirms control information corresponding to the bit information created in step 805. For example, when the portable terminal creates bit information of '01' in step 805, the portable terminal recognizes a sleep state as control information input through an earphone according to Table 2 above. When the portable terminal creates bit information of '10' in step 805, the portable terminal recognizes volume down as control information input through the earphone according to Table 2 above. When the portable terminal creates bit information of '11' in step 805, the portable terminal recognizes volume up as control information input through the earphone according to Table 2 above. When the portable terminal creates bit information of '00' in step 805, the portable terminal recognizes call/end as control information input through the earphone according to Table 2 above.

After confirming the control information input through the earphone, the portable terminal proceeds to step 809 and operates according to the confirmed control information, and then the portable terminal terminates the algorithm.

In the following embodiment, the portable terminal may confirm control information considering bit information and a key input time dependent on a key input provided through an earphone.

Figure 9:
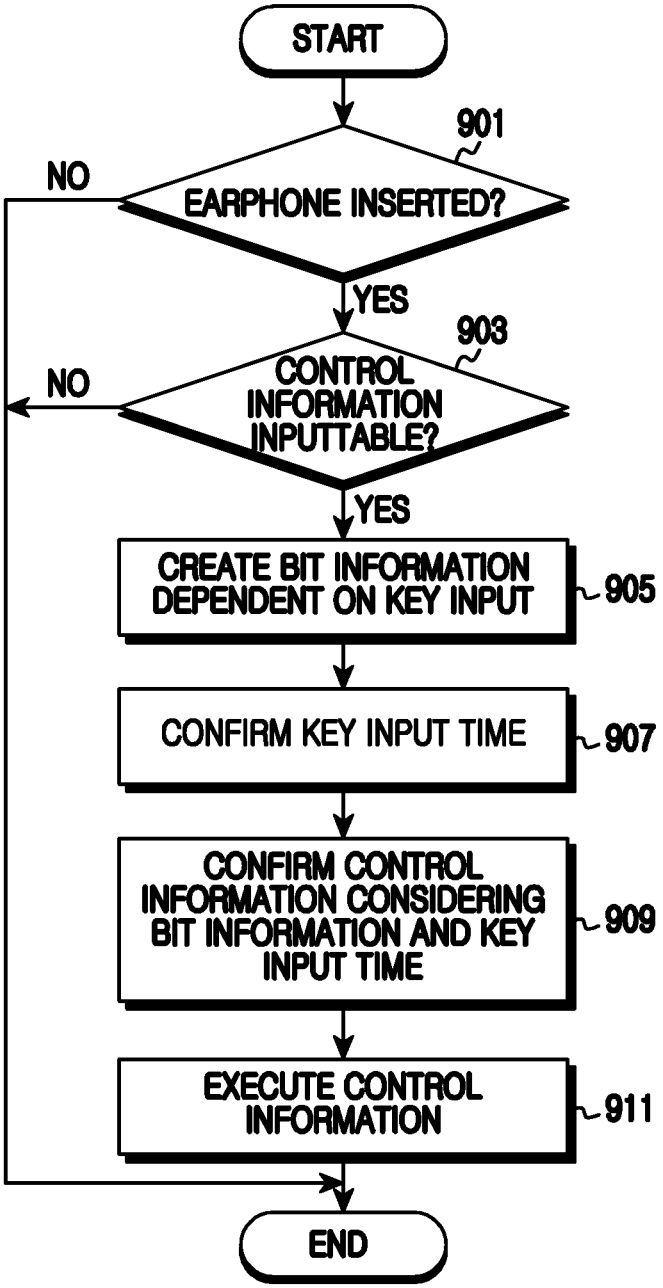
FIG. 9 illustrates a procedure for confirming control information that is input through an earphone in a portable terminal according to another embodiment of the present invention.

FIG. 9 illustrates a procedure for confirming control information that is input through an earphone in a portable terminal according to an embodiment of the present invention.

Referring to FIG. 9, in step 901, the portable terminal determines whether an earphone is inserted into the portable terminal. For example, as in FIG. 6, when the earphone is connected to the portable terminal through its 4-pole interface, the portable terminal determines whether earphone connection information is detected through a 2nd pole 610 of the earphone.

If the earphone is not connected in step 901, the portable terminal terminates the algorithm.

If the earphone is connected in step 901, the portable terminal proceeds to step 903 and determines whether it can be provided with control information from the earphone. For example, when the portable terminal includes a 4-pole interface, the portable terminal determines whether the connected earphone is a 3-pole earphone or is a 4-pole earphone considering a voltage level of a 3rd pole of the 4-pole interface of the portable terminal connected with a microphone device of the 4-pole earphone.

Specifically, when an earphone including a 3-pole interface is inserted into the portable terminal, the 3rd pole of the 4-pole interface of the portable terminal is connected with the ground portion of the 3-pole earphone. In contrast, when an earphone including a 4-pole interface is inserted into the portable terminal, the 3rd pole of the 4-pole interface of the portable terminal is connected with the microphone device of the 4-pole earphone. That is, when the 4-pole earphone is inserted into the portable terminal, a voltage level confirmed at the 3rd pole of the 4-pole interface of the portable terminal is higher than when the 3-pole earphone is inserted. Accordingly, the portable terminal can confirm whether the earphone connected to the 4-pole interface of the portable terminal is the 3-pole earphone or is the 4-pole earphone considering the voltage level of the 3rd pole of the 4-pole interface of the portable terminal.

If the portable terminal cannot be provided with control information through the earphone in step 903, the portable terminal terminates the algorithm. That is, when the 3-pole earphone is connected to the portable terminal, the portable terminal recognizes that it cannot be provided with the control information through the 3-pole earphone. Accordingly, the portable terminal terminates the algorithm.

In contrast, if the portable terminal can be provided with the control information through the earphone in step 903, the portable terminal proceeds to step 905 and creates bit information dependent on a key input provided through the earphone. For example, in the construction of FIG. 5, a reference voltage ($V_{th1}$) of a 1st comparator 500 is set to 1.0 V, an input/output voltage ($V_{IO}$) of the 1st comparator 500 is set to 1.8 V, a reference voltage ($V_{th2}$) of a 2nd comparator 510 is set to 0.5 V, and an earphone is constructed as in FIG. 6.

When a key input of 0.8 V is generated from the earphone, the 1st comparator 500 of the portable terminal outputs '0' (Low) as a 1st bit value because the key input voltage 0.8 V is lower than the reference voltage 1.0 V of the 1st comparator 500. Since the output voltage of the 1st comparator 500 is equal to 0 V, the 2nd comparator 510 determines, by 0.5 V, a reference voltage to be used for determining a 2nd bit value, outputs '1' (High) as the 2nd bit value, and creates bit information of '01'. When a key input of 1.2 V is generated from the earphone, the 1st comparator 500 of the portable terminal outputs '1' (High) as the 1st bit value because the key input voltage 1.2 V is higher than the reference voltage 1.0 V of the 1st comparator 500. Since the output voltage of the 1st comparator 500 is equal to 1.8 V, the 2nd comparator 510 determines, by 1.8 V, the reference voltage to be used for determining the 2nd bit value, outputs '0' (Low) as the 2nd bit value, and creates bit information of '10'.

When a key input of 2.6 V is generated from the earphone, the 1st comparator 500 of the portable terminal outputs '1' (High) as the 1st bit value because the key input voltage 2.6 V is higher than the reference voltage 1.0 V of the 1st comparator 500. Since the output voltage of the 1st comparator 500 is equal to 1.8 V, the 2nd comparator 510 determines, by 1.8 V, the reference voltage to be used for determining the 2nd bit value, outputs '1' (High) as the 2nd bit value, and creates bit information of '11'. When a key input of 0.12 V is generated from the earphone, the 1st comparator 500 of the portable terminal outputs '0' (Low) as the 1st bit value because the key input voltage 0.12 V is higher than the reference voltage 1.0 V of the 1st comparator 500. Since the output voltage of the 1st comparator 500 is equal to 0 V, the 2nd comparator 510 determines, by 0.5 V, the reference voltage to be used for determining the 2nd bit value, outputs '0' (Low) as the 2nd bit value, and creates bit information of '00'.

The portable terminal the proceeds to step 907 and confirms a key input time, which may be continual, through the earphone.

The portable terminal then proceeds to step 909 and confirms control information considering the bit information created in step 905 and the key input time confirmed in step 907. For example, the portable terminal creates bit information of '10' in step 905 and, when a key input time corresponding to the bit information of '10' does not exceed a reference time, the portable terminal recognizes volume down as the control information input through the earphone. In another example, the portable terminal creates the bit information of '10' in step 905 and, when a key input time corresponding to the bit information of '10' exceeds a reference time, the portable terminal may recognize Fast Forward as the control information input through the earphone.

After confirming the control information input through the earphone, the portable terminal proceeds to step 911 and operates according to the confirmed control information, and then terminates the algorithm.

In the aforementioned embodiment, the portable terminal can compare a key input time and a reference time and receive various control information through the earphone. The portable terminal may set a plurality of reference times and receive additional control information.

As described above, embodiments of the present invention have an advantage of, by recognizing control information that is input through an earphone in a level trigger scheme in a portable terminal, controlling a function of the portable terminal using the earphone, and simplifying a hardware design of an accessory such as the earphone connected to the portable terminal.

Methods according to embodiments disclosed in the present invention can be realized in hardware, software, and a form of a combination thereof.

When realizing the methods in software, a non-transitory computer readable storage medium storing one or more programs (software modules) can be provided. One or more programs stored in the computer readable storage medium are constructed to be executable by one or more processors within an electronic device. One or more programs include a command for enabling an electronic device to execute the methods according to the embodiments disclosed in the present invention.

These programs (i.e., software modules or software) can be stored in a Random Access Memory (RAM), a nonvolatile memory including a flash memory, a Read Only Memory (ROM), an electrically erasable programmable ROM, a magnetic disk storage device, a compact disk ROM, a digital versatile disk or an optical storage device of other form, and a magnetic cassette. Or, they can be stored in a memory constructed in combination of some or all of them. Also, each configuration memory may be included in plural.

Further, the programs can be stored in a storage device attachable to an electronic device and accessible through a communication network such as the Internet, an intranet, a Local Area Network (LAN), a Wireless LAN (WLAN), or a Storage Area Network (SAN), or a communication network configured in combination of them. This storage device can access the electronic device through an external port.

Furthermore, a separate storage device on a communication network may access a portable electronic device.

While the invention has been shown and described with reference to certain embodiments thereof, it will be understood by those skilled in the art that various changes in form and details may be made therein without departing from the spirit and scope of the invention as defined by the appended claims.

What is claimed is:

1. A portable terminal apparatus comprising:

an interface to which an earphone is connected; and a controller configured to:

determine whether control information is capable of being provided to the portable terminal through the earphone, and when control information is capable of being provided, create bit information dependent on a key input provided by a user from the earphone connected through the interface, and confirm control information corresponding to the bit information, wherein the bit information comprises a first bit value and a second bit value, wherein a first comparator compares a first reference voltage and a voltage of the key input provided from the earphone, and outputs the first bit value, and a second comparator compares a second reference voltage and a bit output voltage of the first comparator to determine a third reference voltage, compares the third reference voltage and the voltage of the key input provided from the earphone, and outputs the second bit value.

2. The apparatus of claim 1, wherein the interface comprises a 4-pole interface.

3. The apparatus of claim 2, wherein determining whether control information is capable of being provided to the portable terminal through the earphone comprises determining a type of the earphone connected through the interface by considering a voltage level measured at a pole of the 4-pole interface.

4. The apparatus of claim 1, wherein the controller comprises:

a control information detection unit which confirms control information corresponding to the bit information created in the first comparator and the second comparator.

5. The apparatus of claim 4, wherein the control information detection unit detects control information considering the bit information created in the comparators and a sustain time of the key input provided from the earphone.

6. The apparatus of claim 1, wherein the at least one second comparator comprises:

a diode which compares the second reference voltage and the bit output voltage of the $1^{st}$ comparator, and determines a third reference voltage; and a comparator which compares the third reference voltage and the voltage of the key input provided from the earphone, and outputs the second bit value.

7. The apparatus of claim 1, wherein the control information comprises at least one of call, call end, volume up, and volume down.

8. A method of a portable terminal for confirming control information that is input through an earphone connected to the portable terminal, the method comprising:

determining whether the earphone is inserted into an interface of the portable terminal; and when the earphone is inserted, determining whether control information is capable of being provided to the portable terminal through the earphone, and when control information is capable of being provided, creating bit information dependent on a key input provided by a user from the earphone, and confirming control information corresponding to the bit information, wherein creating the bit information comprises:

outputting a first bit value using a first comparator for comparing a first reference voltage and a voltage of the key input provided from the earphone, outputting a second bit value using a second comparator for comparing a second reference voltage and a bit output voltage of the first comparator to determine a third reference voltage, and comparing the third reference voltage and the voltage of the key input provided from the earphone.

9. The method of claim 8, wherein determining whether the earphone is inserted comprises determining whether the earphone is inserted through a 4-pole interface.

10. The method of claim 9, wherein determining whether the control information is capable of being provided to the portable terminal through the earphone comprises considering a voltage level measured at a pole of the 4-pole interface.

11. The method of claim 8, wherein confirming the control information comprises:

confirming a sustain time of the key input provided from the earphone; and detecting the control information considering the bit information and the sustain time of the key input provided from the earphone.

12. The method of claim 8, wherein the control information comprises at least one of call, call end, volume up, and volume down.

* * * * *